US011255114B2

(12) United States Patent
Konrad

(10) Patent No.: US 11,255,114 B2
(45) Date of Patent: Feb. 22, 2022

(54) LOCKING DEVICE AND SLIDING DOOR WITH LOCKING DEVICE

(71) Applicant: FACC AG, Ried im Innkreis (AT)

(72) Inventor: Wilfried Konrad, Ried im Innkreis (AT)

(73) Assignee: FACC AG, Ried im Innkreis (AT)

( * ) Notice: Subject to any disclaimer, the term of this patent is extended or adjusted under 35 U.S.C. 154(b) by 0 days.

(21) Appl. No.: 16/479,208

(22) PCT Filed: Jan. 18, 2018

(86) PCT No.: PCT/AT2018/060013

§ 371 (c)(1),
(2) Date: Jul. 18, 2019

(87) PCT Pub. No.: WO2018/132856

PCT Pub. Date: Jul. 26, 2018

(65) Prior Publication Data

US 2019/0383068 A1 Dec. 19, 2019

(30) Foreign Application Priority Data

Jan. 18, 2017 (AT) ..... 50031/2017

(51) Int. Cl.
*E05B 63/12* (2006.01)
*E05C 1/08* (2006.01)
(Continued)

(52) U.S. Cl.
CPC ..... *E05C 1/08* (2013.01); *E05B 17/2011* (2013.01); *E05B 63/121* (2013.01); *E05C 19/04* (2013.01);
(Continued)

(58) Field of Classification Search
CPC ..... Y10T 292/14; Y10T 292/0808; Y10T 292/0815; Y10T 292/0824;
(Continued)

(56) References Cited

U.S. PATENT DOCUMENTS 141,019 A * 7/1873 Staples ..... E05B 83/243 292/114
161,023 A * 3/1875 Gale ..... E05B 15/0053 292/152
(Continued)

FOREIGN PATENT DOCUMENTS

AU 486349 B2 3/1976
CN 102155129 A 8/2011
(Continued)

OTHER PUBLICATIONS

ISA European Patent Office, International Search Report Issued in Application No. PCT/AT2018/060013, dated Mar. 23, 2018, WIPO, 4 pages.
(Continued)

*Primary Examiner* — Carlos Lugo
(74) *Attorney, Agent, or Firm* — McCoy Russell LLP

(57) ABSTRACT

A locking device for locking a first component to a second component, the device having: a catch element for fastening to the first or second component; a latching unit for fastening to the second or first component; the latching unit comprising a release element; and the release element can be moved between a rest position, which arranges the first latching body in the first latching recess of the catch element and in the receiving opening of the release element, and a release position, which releases the engagement between the first latching body and the first latching recess of the catch element.

12 Claims, 13 Drawing Sheets

(51) Int. Cl.
*E05B 83/40* (2014.01)
*E05C 19/04* (2006.01)
*E05B 17/20* (2006.01)

(52) U.S. Cl.
CPC ..... *E05Y 2900/502* (2013.01); *Y10S 292/46* (2013.01); *Y10T 292/0814* (2015.04); *Y10T 292/14* (2015.04)

(58) Field of Classification Search
CPC ..... Y10T 292/0969; Y10T 292/0977; Y10T 292/0995; Y10T 292/0997; Y10T 292/1022; Y10T 292/1023; Y10T 292/1028; Y10T 292/103; Y10S 292/46; E05C 19/04; E05C 19/06; E05B 17/2011; E05B 63/121
See application file for complete search history.

(56) References Cited

U.S. PATENT DOCUMENTS 489,291 A * 1/1893 Doran ..... E05B 63/121 292/252
582,871 A * 5/1897 Monteer ..... E05B 63/121 292/252
802,041 A * 10/1905 Hartman ..... E05B 65/0864 292/153
983,647 A * 2/1911 Romines ..... E05C 19/105 292/111
1,089,193 A * 3/1914 Ervien ..... E05F 7/005 292/15
1,467,782 A * 9/1923 Englund ..... E05C 17/52 292/15
2,593,662 A * 4/1952 Dickinson ..... F16B 5/10 292/252
2,842,814 A * 7/1958 Lindgren ..... E04B 1/6141 160/113
2,857,191 A * 10/1958 Buchholtz ..... E05B 65/0053 292/17
2,869,952 A * 1/1959 Saunders ..... E05C 19/02 312/405
3,129,024 A * 4/1964 Schuessler ..... E05C 17/52 292/15
3,151,901 A * 10/1964 Aldgren ..... E05D 13/04 292/124
3,450,851 A * 6/1969 Perl ..... D06F 37/42 200/61.68
3,553,984 A * 1/1971 Grumbach ..... E05B 65/08 70/99
3,764,172 A * 10/1973 Standke ..... E05B 63/121 292/15
3,788,007 A * 1/1974 Bailey ..... E05D 13/04 49/449
4,086,794 A * 5/1978 Richards ..... E05B 17/2011 292/147
4,100,657 A * 7/1978 Minolla ..... A44B 11/2511 24/642
RE30,718 E * 8/1981 Etchell ..... B41F 27/14 101/415.1
4,468,843 A * 9/1984 Duclos ..... A44B 11/2534 24/635
4,512,597 A * 4/1985 Nabb ..... E05B 63/121 292/143
4,586,425 A * 5/1986 Redman ..... F15B 15/261 188/67
4,788,796 A * 12/1988 Matthews ..... B60J 1/1853 292/147
4,993,757 A * 2/1991 Corzine ..... E05B 47/0002 292/144
5,024,474 A * 6/1991 Selby, III ..... E05B 17/2011 292/140
5,224,297 A * 7/1993 Watkins ..... E05B 17/04 292/210
5,494,323 A * 2/1996 Huang ..... E05B 63/121 24/453
6,014,796 A * 1/2000 Harrison ..... A44B 11/2546 24/633
6,077,011 A * 6/2000 Walker ..... F16B 21/165 24/453
6,186,444 B1 * 2/2001 Steel ..... B64C 1/1423 244/129.5
6,415,476 B1 7/2002 McCoy
6,532,702 B1 * 3/2003 Scribner ..... E06B 9/02 411/348
7,587,956 B2 * 9/2009 Velasco, Jr. ..... G05G 5/06 74/110
8,146,864 B2 * 4/2012 Koppel ..... E05B 79/20 244/129.5
8,960,734 B2 * 2/2015 Camp ..... E05B 17/0037 292/193
9,157,255 B2 * 10/2015 Stendal ..... E05B 47/026
2013/0149029 A1 6/2013 Changsrivong et al.

FOREIGN PATENT DOCUMENTS

CN 103619706 A 3/2014
DE 3905353 A1 8/1990
DE 202011102484 U1 12/2011
DE 202011102487 U1 12/2011
EP 0499296 A2 8/1992
WO 2014089943 A1 6/2014

OTHER PUBLICATIONS

State Intellectual Property Office of the People's Republic of China, Office Action and Search Report Issued in Application No. 201880007581.8, dated Apr. 22, 2020, 9 pages. (Submitted with Partial Translation).

* cited by examiner

LOCKING DEVICE AND SLIDING DOOR WITH LOCKING DEVICE

CROSS-REFERENCE TO RELATED APPLICATIONS

The present application is a U.S. National Phase of International Patent Application Serial No. PCT/AT2018/060013 entitled "LOCKING DEVICE AND SLIDING DOOR WITH LOCKING DEVICE," filed on Jan. 18, 2018. International Patent Application Serial No. PCT/AT2018/060013 claims priority to Austrian Patent Application No. A 50031/2017 filed on Jan. 18, 2017. The entire contents of each of the above-referenced applications are hereby incorporated by reference for all purposes.

TECHNICAL FIELD

The invention relates to a locking device for locking a first component, in particular a door leaf, to a second component, in particular to a door frame, with a catch element for fastening to the first or second component, wherein the catch element comprises a first latching recess, with a latching unit for fastening to the second or first component, wherein the latching unit comprises a first latching body for engagement with the at least one latching recess of the catch element.

BACKGROUND AND SUMMARY

The invention further relates to a sliding door, in particular for an aircraft, with a door frame, with a door leaf that can be displaced between an open position and a closed position relative to the door frame, and with a locking device for locking the door leaf to the door frame.

Known in prior art are a wide variety of locking devices, which among other things are also used in sliding doors, so as to fix the sliding door in the closed position.

An activating mechanism for enabling the closing process is frequently provided for sliding doors in aircraft. The activating mechanism typically has a handle, which is arranged next to an access opening of the sliding door on a frame structure. Activating the handle activates a latching mechanism, with which the sliding door is fixed in the open position. In prior art, the latching mechanism comprises a latching unit that is fastened to the frame structure and has reciprocally swivelable latching hooks, which form a latching receptacle for a corresponding latching element on the sliding door. Once the open position of the sliding door has been reached, the latching element of the sliding door is engaged in the latching receptacle of the latching unit. In order to initiate the closing process, the handle is activated, as a result of which the latching hooks are swiveled outwardly against the spring force, so that the latching engagement is released. With the latching connection disengaged, the sliding door can be transferred into the closed position, in particular while being acted upon by a driving element.

The disadvantage to the known latching mechanism on the one hand is the noise generation that accompanies operation, which can be perceived as annoying by users of the sliding door. In addition, the known latching mechanism requires comparatively high operating forces, which hamper sliding door activation. Furthermore, it is desirable to reduce the installation space for the latching mechanism. Another goal is to reduce weight, especially in aircraft technology. Finally, reliability during continuous use must be improved as well.

Known from US 2013/149029 A1 is a different type of locking system, which is provided among other things for doors. In this locking system, a pin is introduced into a housing. Two locking positions can here be assumed by latching two opposing annular springs into notches provided for this purpose in the pin and housing, when the pin is pushed into the housing in the one direction. The pin can only be moved back in the other direction if the annular springs are turned into the initial position by arranging the pin in the second locking position, whereupon the pin can be removed from the housing supported by a force (e.g., magnetism).

This prior art is also unable to satisfactorily resolve the problems described above associated with the latching mechanisms used first and foremost in aircraft sliding doors.

As a consequence, the object of the invention lies in ameliorating or eliminating at least individual disadvantages of the prior art described at the outset. For this reason, the object of the invention in particular is to improve the known locking devices, so as to make it possible to economize on weight, reduce the space required for installing the locking device, decrease the operating forces during use and/or enable a quieter activation.

According to the invention, the latching unit comprises a release element, which comprises a first receiving opening for receiving the first latching body, wherein the release element can be moved between a resting position, which arranges the first latching body in the first latching recess of the catch element and in the receiving opening of the release element, and a release position, which releases the engagement between the first latching body and the first latching recess of the catch element.

Therefore, the locking device according to the invention provides a separate release element, whose receiving opening receives the first latching body when the catch element and first latching body are arranged in the engaged state. By moving, in particular displacing, the release element, the first latching body is guided along a boundary surface of the receiving opening of the release element in such a way that the first latching body is pressed out of the first latching recess of the catch element. As a result, the catch element and first latching body are arranged in the disengaged state, thereby releasing the movement of the catch element relative to the latching unit in the direction opposite the insertion direction of the catch element during introduction into the latching unit. The first latching recess of the catch element (catcher) and first receiving opening of the release element (releaser) are preferably each designed as a notch on a longitudinal edge of the catcher or release element. As opposed to prior art, it is thus not necessary to release the catcher on the movable component by swiveling latching hooks on the stationary component. According to the invention, the catch element can instead be released by activating the release element present separately from the first latching body or the catch element, in whose first receiving opening the first latching body is arranged in the engaged state. The release element is preferably connected with an activating element, which allows a user of the locking device to activate the release element. For example, a button or slider can be provided as the activating element. The activating element is connected with the release element in a suitable manner, for example by an electromagnetic or mechanical coupling device. The inventive construction makes it possible to provide a locking device characterized by a low weight, compact construction, and both a quiet and smooth operation. In particular, it is also advantageous that the release force can be lowered relative to prior art. As a result, less stringent requirements are placed on the release of the locking device, in particular on the coupling device between the activating element and release element.

In order to easily and reliably disengage the locking device, it is favorable that the latching unit comprises a first linear guide for displaceably mounting the release element between the resting position and release position. In this embodiment, the release element is mounted on the latching unit so that it can be displaced between the resting and release positions along an essentially straight guideway. The first linear guide of the latching unit preferably extends essentially parallel to the guiding path of the catch element relative to the latching unit. The latching unit can comprise a first stop for establishing the resting position, and a second stop for establishing the release position. During use, the release element can be activated in the engaged state between the first latching body and the catch element, so as to guide the first latching body out of the first latching recess of the catch element. This releases the latching engagement between the first latching body and the catch element, thereby enabling an (additional) movability of the catch element relative to the latching unit.

In particular, this embodiment also brings with it the advantage that the locking device can be adjusted to various types of activation in an especially easy manner. In a preferred embodiment, the release element can essentially be displaced in the direction of movement of the catch element during engagement with the latching unit. As a result, this embodiment makes it possible to disengage the locking device by applying a tensile force to the release element, which moves the release element away from the center of the latching unit. In an alternative preferred embodiment, the release element can be displaced essentially opposite the direction of movement of the catch element during engagement with the latching unit. In this embodiment, the release element can be pressed in the direction of the center of the latching unit for disengaging the locking device. The configuration of the locking device thus makes it possible to take into consideration the requirements placed on the respective application with slight structural changes.

In order to precisely and reliably bring the catch element and the latching unit into the engaged state, it is favorable for the latching unit to comprise a second linear guide for mounting the first latching body so that it can be displaced between a first position engaged with the first latching recess of the catch element and a second position that releases the catch element, wherein the second linear guide preferably extends essentially perpendicularly to the first linear guide. By activating the release element, the first latching body along the second linear guide can be pressed out of both the first latching recess of the catch element and out of the first receiving opening of the release element, which transfers the catch element and the latching unit into the disengaged state. The arrangement of the second linear guide essentially perpendicular to the first linear guide is accompanied by a compact construction, in which engagement and disengagement can be effected through comparatively short displacements of the first latching body.

In order to engage the catch element with the latching unit, it is particularly favorable for the latching unit to comprise a first spring element, wherein the first latching body can be displaced against the spring force exerted by the first spring element from the first position engaged with the first latching recess of the catch element into the second position that releases the catch element. Accordingly the first spring element presses the first latching body in the direction of the first position within the first latching recess of the catch element. At an end facing the latching unit, the catch element preferably comprises a run-up surface that in particular runs inclined to the direction of movement of the catch element, which run-up surface can press the first latching body in the direction of the second position before the first latching body engages into the first latching recess of the catch element.

In order to achieve an especially compact construction, the catch element is preferably designed as an oblong flat part, wherein the first latching recess is provided on a first longitudinal edge of the oblong flat part. In this embodiment, the catch element comprises a main plane, along which the catch element comprises an expansion many times larger than along a cross sectional surface perpendicular thereto. As a consequence, the catch element in this embodiment is essentially plate-shaped. In the assembled state, the main plane of the catch element preferably extends essentially parallel to a door plane of the first or second component. The oblong catch element is preferably elongated in the direction of displacement of the catch element. This advantageously makes it possible to achieve an especially flat and light locking device, which is suitable in particular for the confined space conditions for an aircraft door.

For the reasons mentioned above, it is also advantageous that the release element be designed as an oblong flat piece, wherein the first receiving opening is provided on a first longitudinal edge of the oblong flat piece. In this embodiment, the release element comprises a main plane, along which the catch element comprises an expansion many times larger than along a cross sectional surface perpendicular thereto. As a consequence, the release element in this embodiment is essentially plate-shaped. In the assembled state, the main plane of the release element preferably extends essentially parallel to a door plane of the first or second component. The release element is preferably oblong in the direction of displacement along the first linear guide.

Especially high latching forces can be achieved if the latching unit comprises a second latching body for engagement with a second latching recess of the catch element and for receiving in a second receiving opening of the release element, wherein the second latching recess of the catch element is provided on a second longitudinal edge of the catch element and the second receiving opening of the release element is provided on a second longitudinal edge of the release element. The first and second latching bodies are preferably essentially identical in design.

The locking device described above can be easily tailored to various applications.

In a first preferred embodiment, the catch element in an engaged state is essentially immovably fixed on the latching unit between the first latching body and first latching recess of the catch element. In this embodiment, the movability of the catch element relative to the latching unit in an engaged state is blocked in the insertion direction and opposite the insertion direction of the catch element into the locking unit.

In a second preferred embodiment, the first latching recess of the catch element comprises a first locking surface and a second locking surface, such that the catch element in the engaged state between the first latching body and first latching recess of the catch element is arranged on the latching unit so that it can be moved over a defined stretch. In this embodiment, the first latching recess is bounded on the opposing sides by the first and second locking surface, which are arranged spaced apart from each other by a distance at which the first latching body can be made to abut against the first locking surface on the one hand and the second locking surface on the other by displacing the catch element over the prescribed stretch. The first and second locking surfaces are designed in such a way that the catch element cannot be displaced beyond the first or second locking surface without activating the release element. With the locking device in a built-in state, this embodiment makes it possible to compensate for tolerances.

In a third preferred embodiment, the catch element in an engaged state between the first latching body and first latching recess of the catch element is arranged displaceably on the latching unit in the one direction, and essentially immovably on the latching unit in the other direction. In this embodiment, the latching recess of the catch element can comprise a locking or retaining surface at the front end (relative to the insertion direction of the catch element into the latching unit) and a run-up surface at the rear end. The retaining surface is designed in such a way, in particular inclined in such a way, that the catch element in the engaged state (at typical usage forces) is secured against displacement opposite the insertion direction of the catch element. By contrast, the run-up surface of the latching recess is designed in such a way, in particular inclined in such a way, as to release a continued displacement in the insertion direction of the catch element in the engaged state. In this embodiment, a stop element can be provided outside of the latching unit, which stop element defines the end position of the catch element in the insertion direction. This makes it possible to consider tolerances in the built-in state.

A cylinder element is preferably provided as the first and/or second latching body.

In an especially preferred application, the locking device described above is provided for a sliding door, in particular in an aircraft. Optimal use can here be made of the advantages of the locking device with regard to weight, size, reliability during continuous operation and operating force.

In a preferred embodiment, the locking device is designed for locking the door leaf in the closed position, wherein an additional locking device as described above is provided for locking the door leaf in the open position. As a consequence, two identical locking devices can be provided, which make it possible to lock the sliding door in the closed and open positions.

According to an especially preferred embodiment, the door leaf comprises an upper door part and a lower door part, which are arranged in an extended position in the closed position of the door leaf, and in a pushed together stowage position in the open position. Such a sliding door is referred to as a stowable sliding door (pocket door). As a result of this configuration, the sliding door can be stowed in a section provided for this purpose when the sliding door is completely open. Such sliding doors are known in the art, for example see DE 20 2011 102 487 U1 and DE 20 2011 102 484 U1. In this embodiment, the upper door part and lower door part can be telescoped into each other in a direction essentially perpendicular to the opening direction of the sliding door (i.e., essentially perpendicular to the aircraft floor), so that the door leaf can be stowed in an especially compact manner in the open position.

In order to bring the door leaf into the compact stowage position while opening the sliding door, the door frame preferably comprises a guide rail that runs at an angle of inclination to the horizontal for displaceably mounting the door leaf, so that the displacement of the door leaf between the closed and open positions can be converted into a displacement of the upper door part and lower door part opposite each other between the extended position and the pushed together stowage position. For purposes of the present disclosure, the locational and directional information in this embodiment relate to the assembled operating state of the sliding door in a horizontal position of the aircraft.

The invention will be explained in more detail below based on preferred exemplary embodiments, but with no intent of being limited thereto.

BRIEF DESCRIPTION OF THE FIGURES

FIG. 1B shows the detail A highlighted on FIG. 1A;

FIG. 1C shows the detail B highlighted on FIG. 1A;

DETAILED DESCRIPTION

Figure 1A:
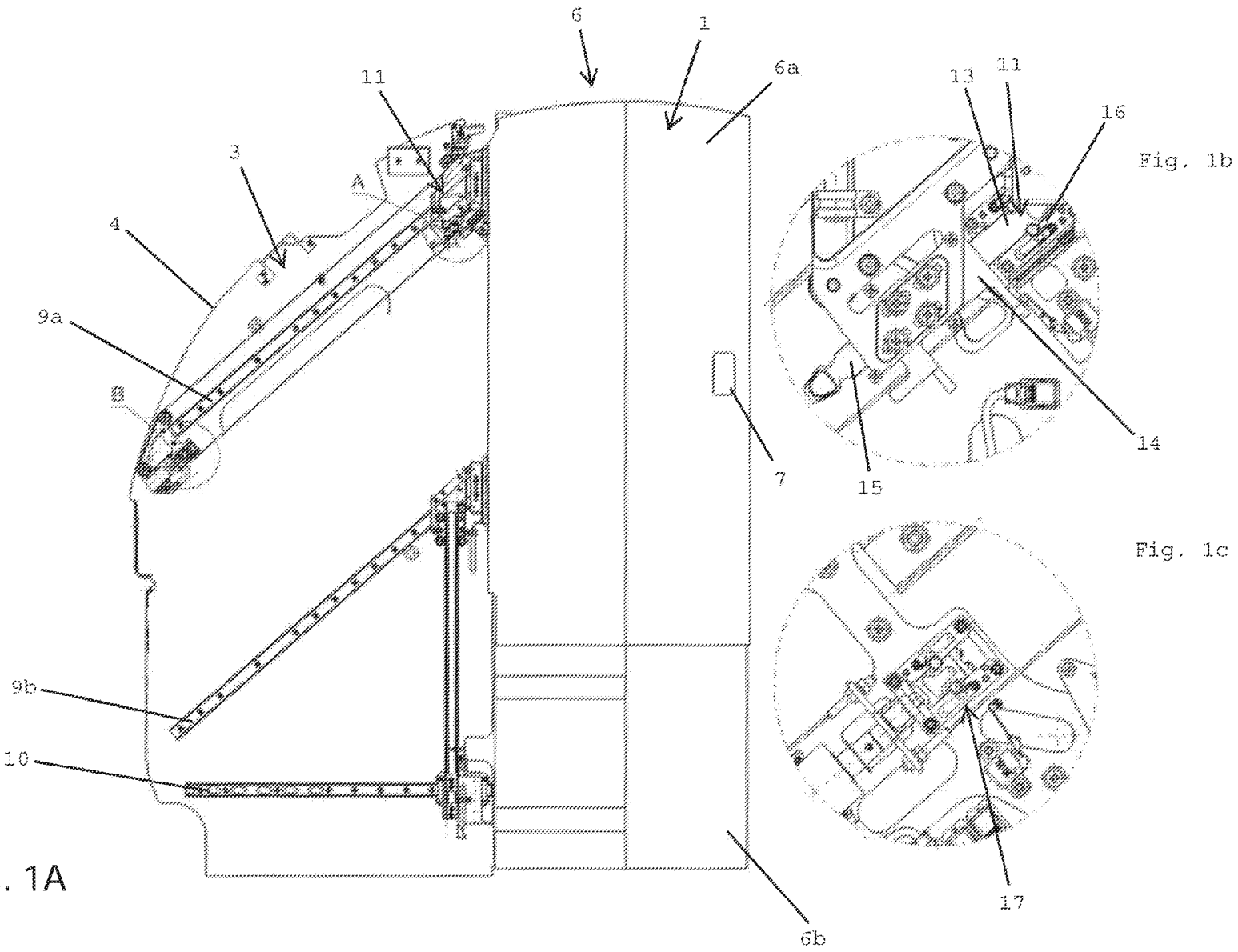
FIG. 1A shows a stowable sliding door in its closed position, wherein one respective locking device according to the invention is provided for locking the sliding door in the closed position (FIG. 1A) and in the open position (FIG. 2A)
Figures 2A, 2B, 2C:
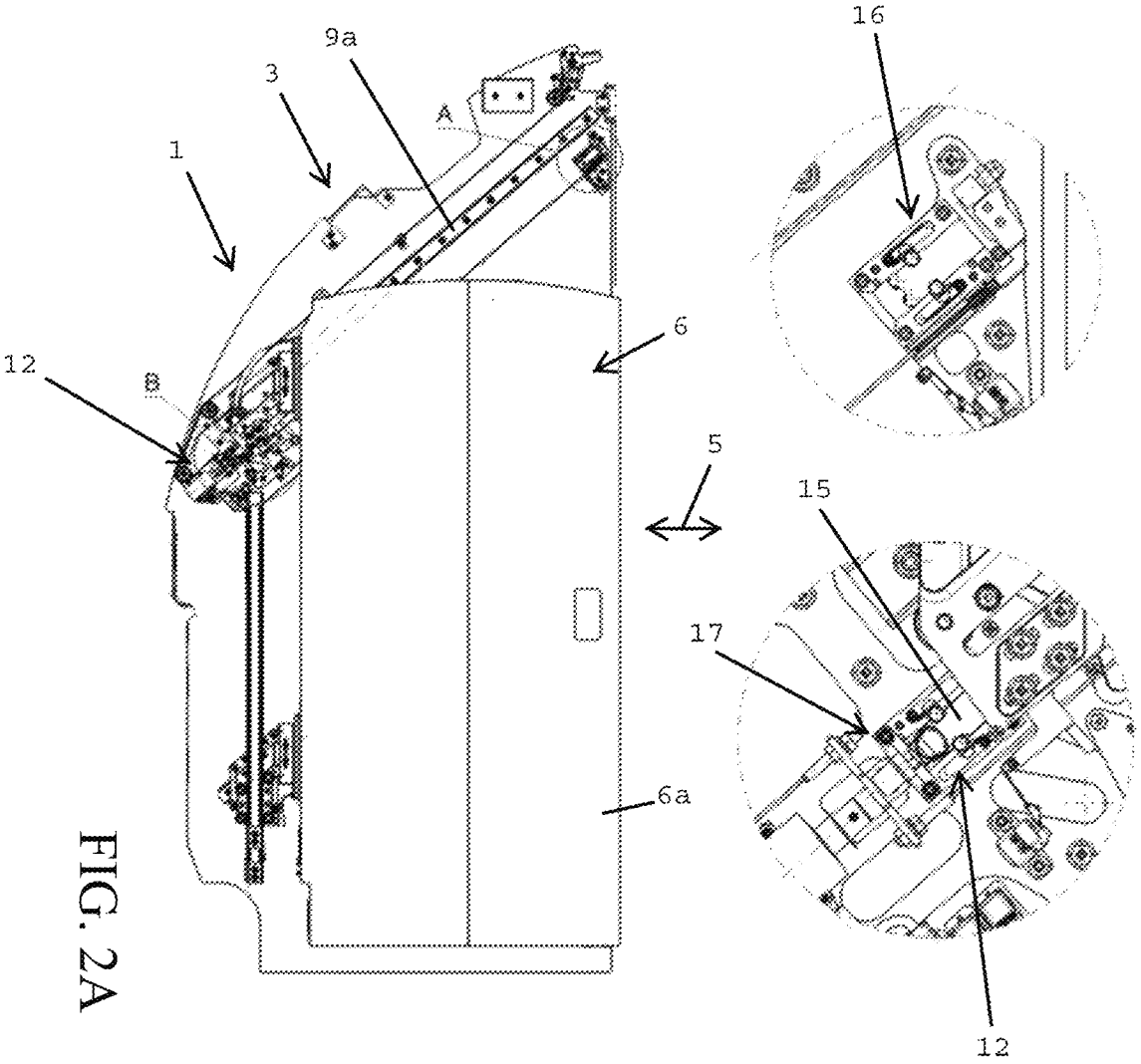
FIG. 2A shows the stowable sliding door according to FIG. 1A to 1C in its open position.
FIG. 2B shows the detail A highlighted on FIG. 2A.
FIG. 2C shows the detail B highlighted on FIG. 2A.
Figure 3:
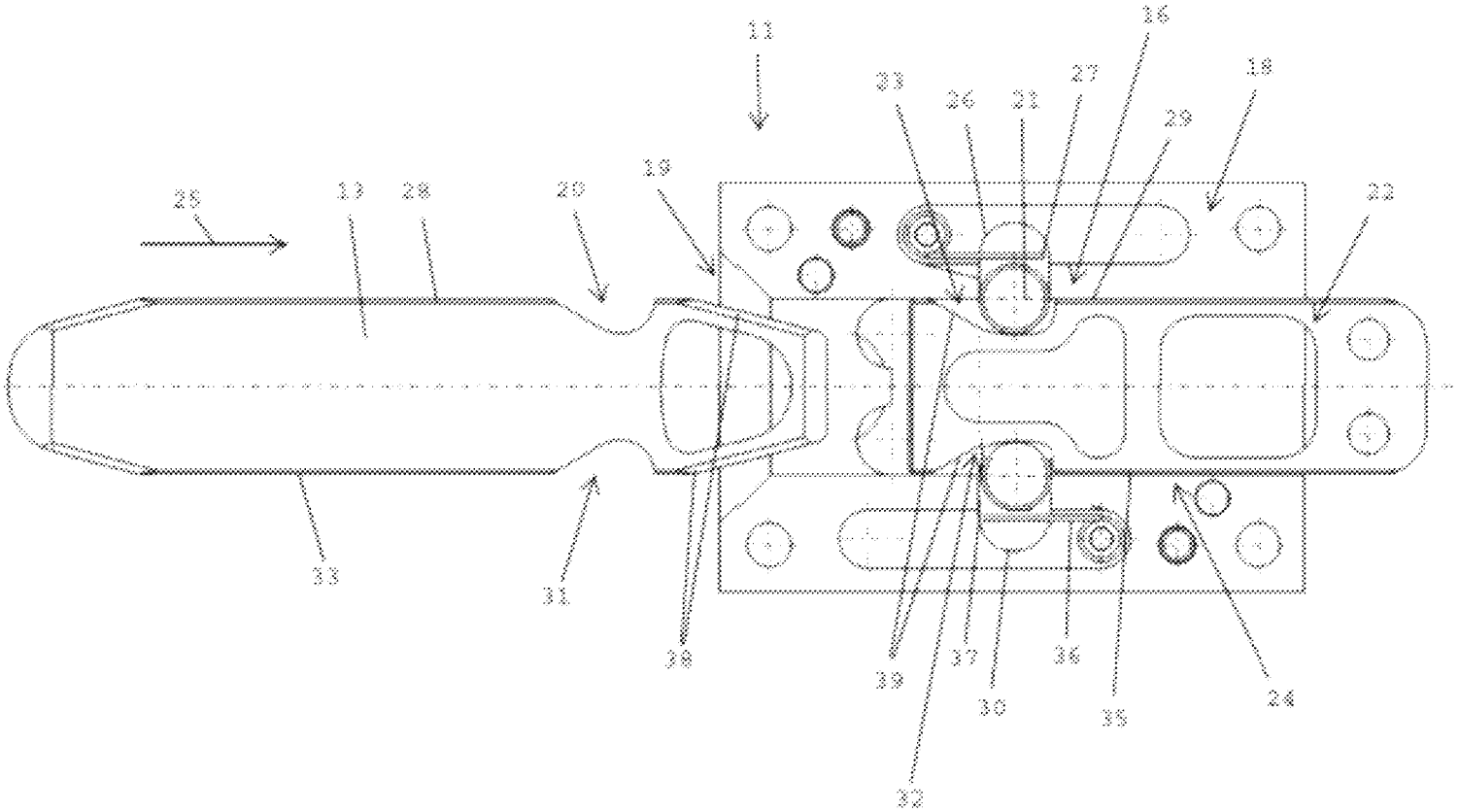
FIG. 3 to 6 show several views of the locking device according to FIG. 1A, 2A while engaging a movable catch element on the door leaf with a stationary latching unit on the door frame.
Figure 4:
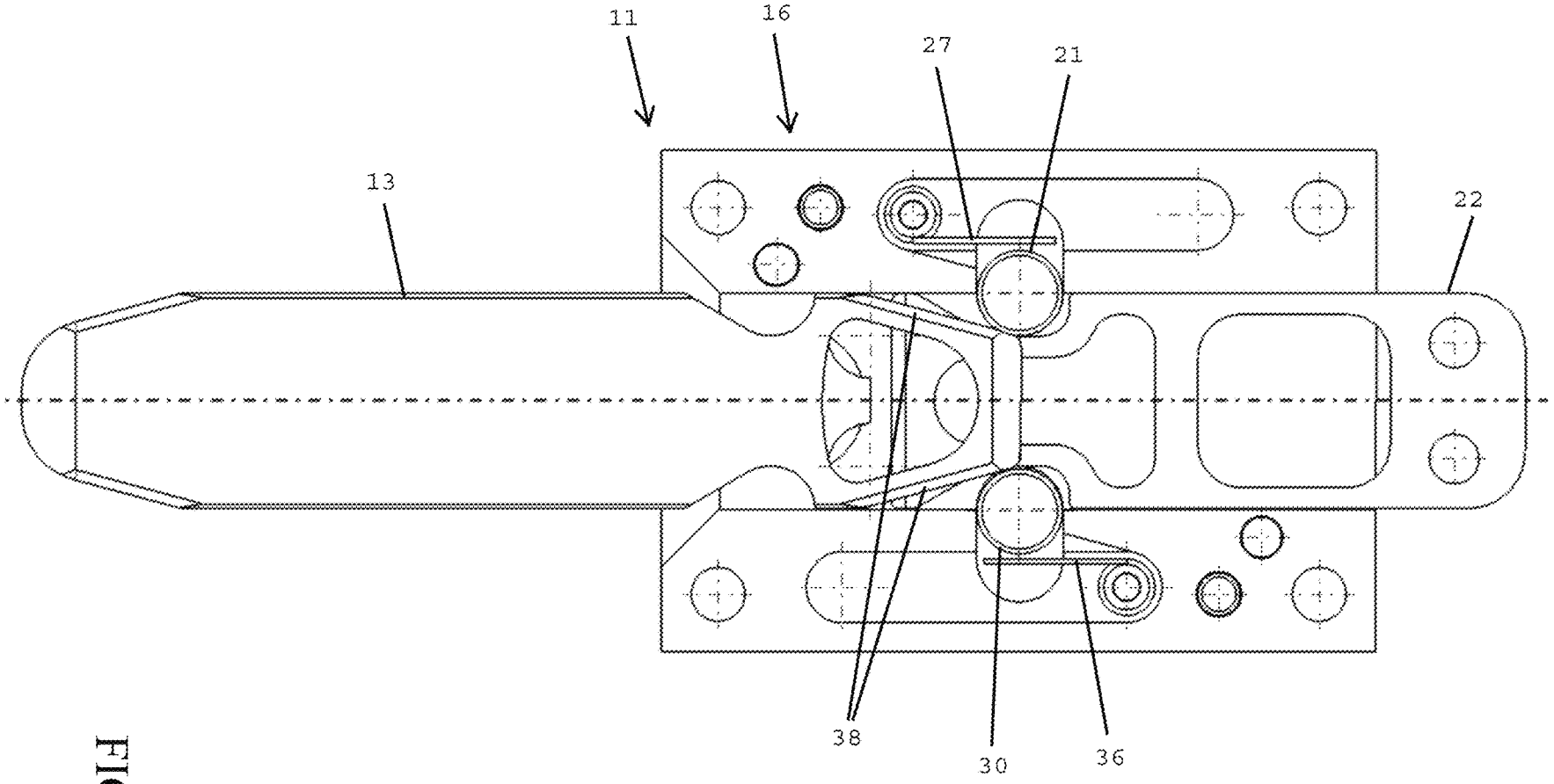
Figure 5:
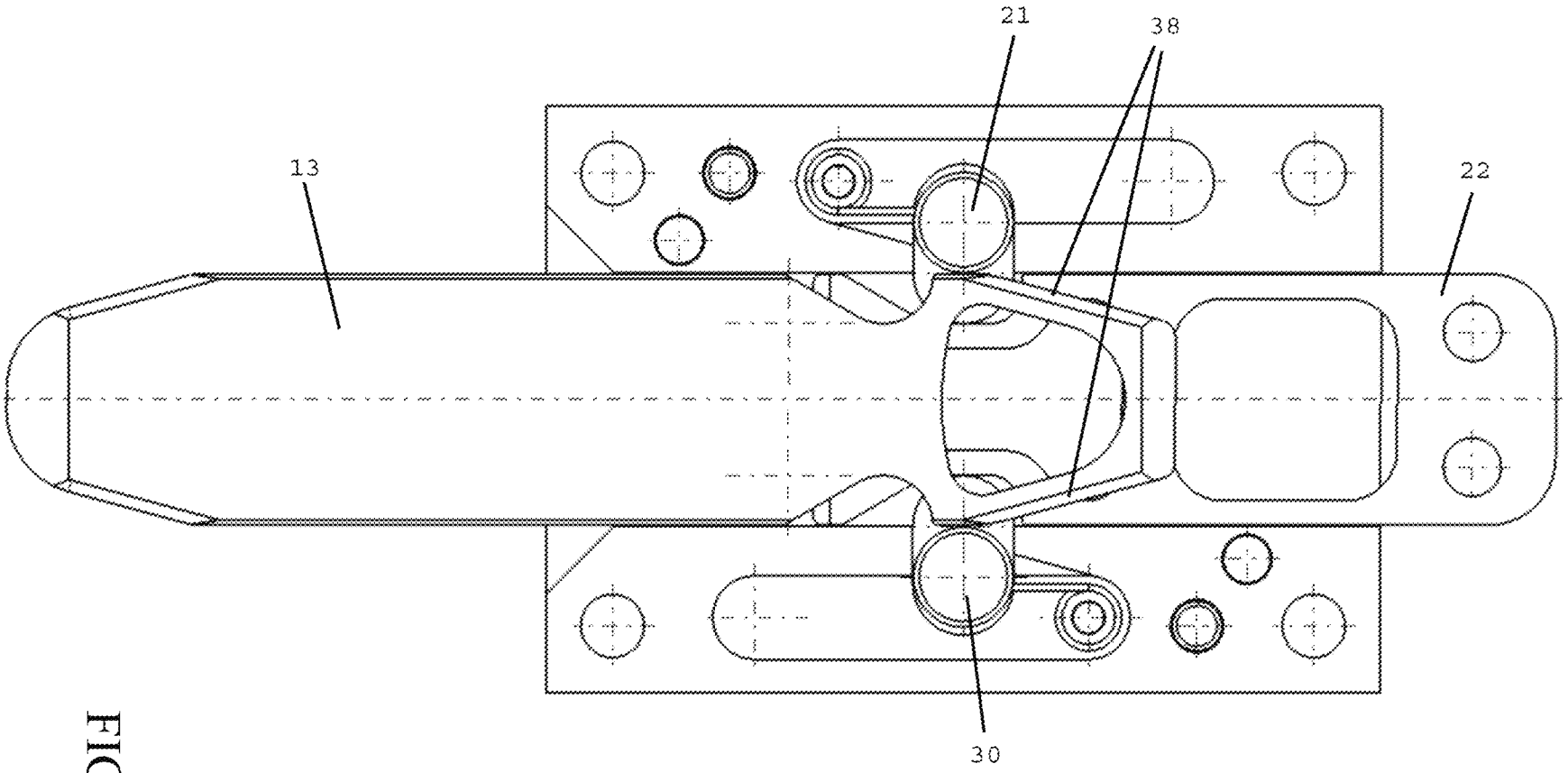
Figure 6:
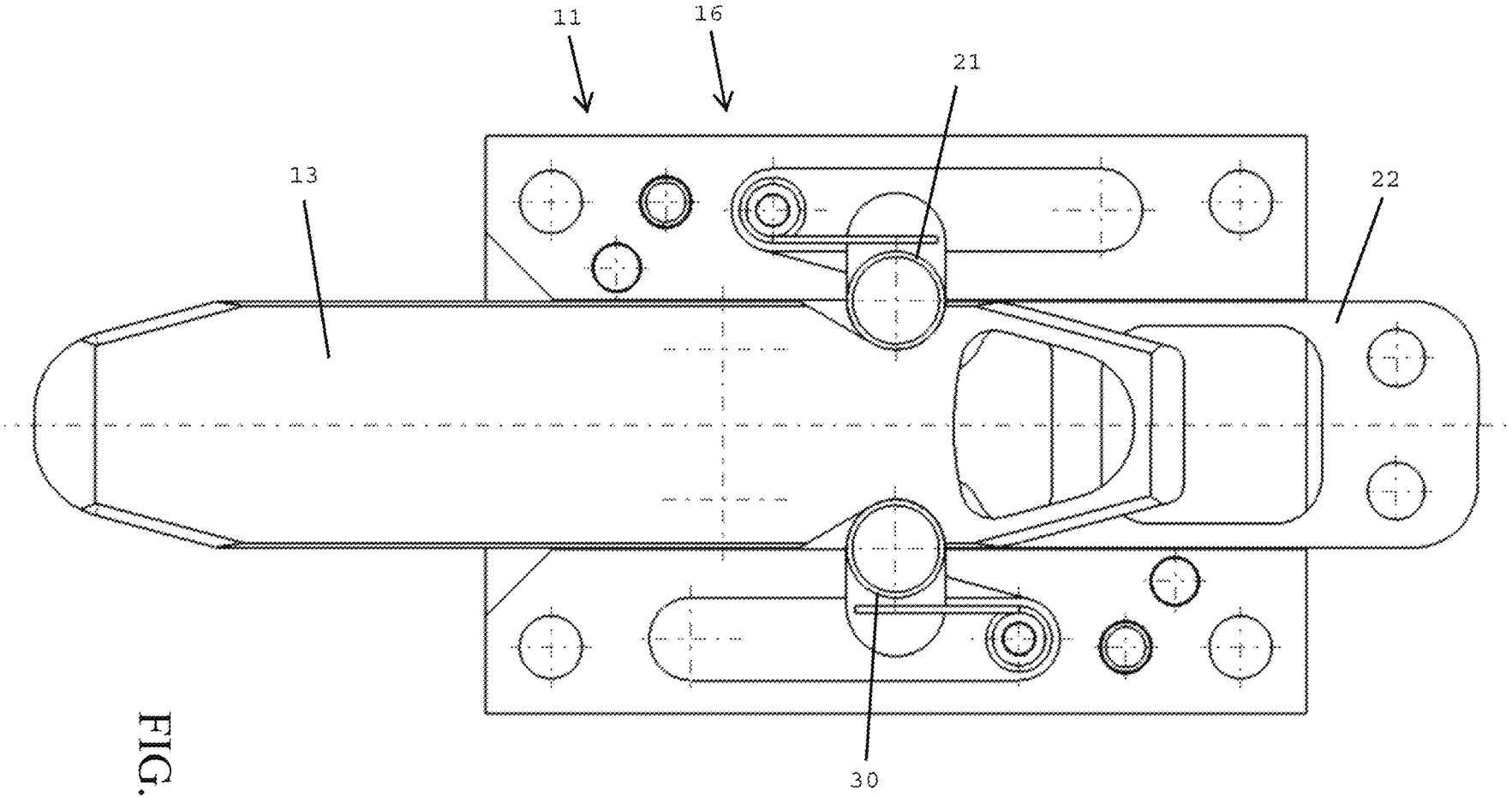
Figure 7:
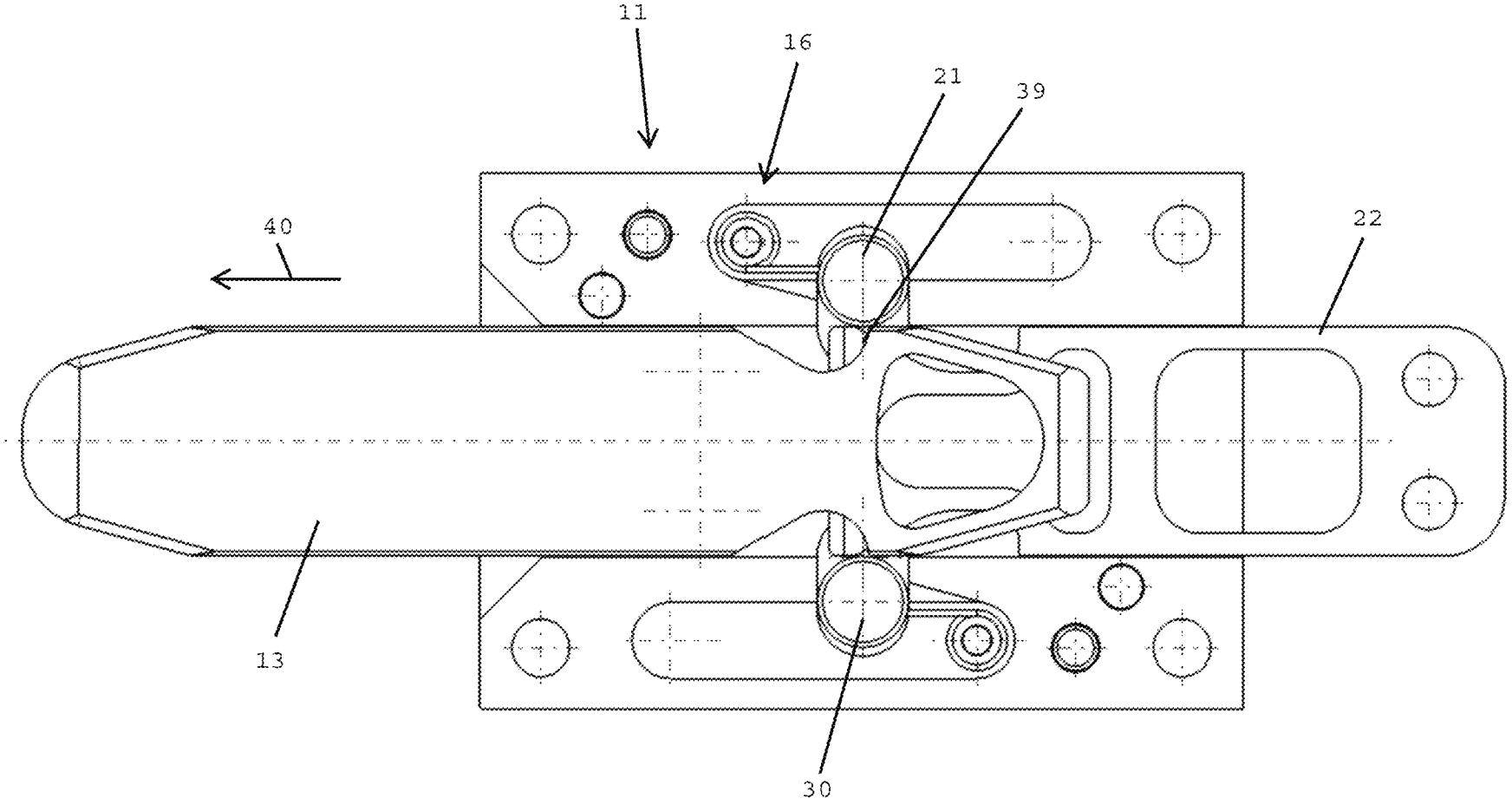
FIG. 7 shows a view of the locking device after disengagement by a release element, which is displaceably mounted on the latching unit.

FIGS. 1A and 2A show a stowable sliding door 1, which in the embodiment shown is used in the passenger compartment of an aircraft. The sliding door 1 is used to close an access opening 2 (see FIG. 2A) within a stationary door frame 3, for example which is designed as a partition wall of the aircraft. The door frame 3 has a border 4, which in the embodiment shown is curved like the inner contour of the aircraft fuselage. As a consequence, only a reduced stowage space is available next to the access opening 2, requiring an adjustment of the sliding door 1 to prevent the sliding door 1 from being blocked by the curved border 4 of the frame structure 3 during the opening process.

As evident from FIGS. 1A and 2A, the sliding door 1 can be displaced in a horizontal direction 5 (see FIG. 2A) between the closed position shown on FIG. 1A, in which the access opening 2 is closed, and the open position shown on FIG. 2A, in which the access opening 2 is open. The sliding door 1 comprises an upper door part 6*a* and a lower door part 6*b*, which together form a door leaf 6. In the closed position of the sliding door 1 (see FIG. 1A), the upper door part 6*a* and lower door part 6*b* are arranged in an extended position, in which the door leaf 6 completely fills the access opening 2.

In order to be able to stow the sliding door 1 in a space-saving manner next to the access opening 2, the upper door part 6*a* and lower door part 6*b* are pushed together perpendicularly to the direction 5 of the opening movement when the sliding door 1 is opened by means of a handle 7.

Stowable sliding doors 1 like these are sufficiently known in the art, wherein various stowing mechanism were proposed. Only one exemplary embodiment will be described below.

In the embodiment shown, the upper door part 6*a* is displaced downward, and the lower door part 6*b* is essentially displaced in a horizontal direction, so that the upper door part 6*a* increasingly overlaps the lower door part 6*b* while opening the sliding door 1. Once the open position of the sliding door 1 (see FIG. 2A) has been reached, the lower edges of the upper door part 6*a* and lower door part 6*b* are arranged at essentially the same height, so that the overall height of the sliding door 1 in the pushed-together stowage position essentially corresponds to the height of the upper door part 6*a*.

As further evident from FIG. 1A, the upper door part 6*a* in the embodiment shown is mounted so that it can be displaced by means of a guide rail 9*a*, which is fastened to the door frame 3.

In the embodiment shown, the upper door part 6*a* is connected with a second guide rail 9*b* that runs essentially parallel to the guide rail 9*a* so as to increase the stability. The guide rails 9*a*, 9*b* with which the upper door part 6*a* is displaceably mounted run at an angle of inclination to the horizontal. The lower door part 6*b* is displaceably mounted by means of a horizontal guide rail 10 fastened to the door frame 3. The upper door part 6*a* can be coupled with a drive or spring unit (not shown). In a preferred embodiment, the door leaf 6, once released by the user (see below), is automatically transferred from the closed position (see FIG. 1A) into the open position (see FIG. 1A), wherein the closing process is conversely manually supported by the user.

As evident from FIG. 1A, in detail from FIG. 1B, a locking device 11 for locking the door leaf 6 in the closed position of the sliding door 1 is provided on the door frame 3. In the embodiment shown, an additional locking device 12 is also provided for locking the door leaf 6 in the open position (see FIG. 2C). The locking device 11 comprises a hook or catch element 13, which is fastened to a guide carriage 14, which can be displaced along the guide rail 9*a* when opening the sliding door 1. Also provided on the guide carriage 14 is another hook or catch element 15 of the additional locking device 12. In the closed position of the sliding door 1, the catch element 13 of the locking device 11 can be engaged with a latching unit 16, which is immovably secured to the door frame 3. Accordingly, an additional latching unit 17 is immovably secured to the door frame 3. The other catch element 15 of the additional locking device 12 can be engaged to the other latching unit 17 in the open position of the sliding door 1 (see FIG. 2C).

The function of the locking device 11 is visible in detail from FIGS. 3 to 7. When reference is made below to features of the locking device 11, a corresponding embodiment can always be provided for the additional locking device 12.

As evident from FIGS. 3 to 7, the latching unit 16 comprises a housing 18, on which an insertion opening 19 is formed for the catch element 13. For better clarity, the drawing only shows one of two half-shells of the housing 18. The catch element 13 comprises a latching recess 20 for engaging with a first latching body 21 of the latching unit 16. In addition, the latching unit 16 comprises a release element 22, on which a first receiving opening 23 is formed for receiving the latching body. The release element 22 in the engaged state can be moved between the catch element 13 and the latching unit 16 (see FIG. 6) from a resting position that arranges the first latching body 21 in the first latching recess 20 of the catch element 13 and the first latching body 21 in the first receiving opening 23 of the release element 22 (see FIG. 6) to a release position that releases the engagement between the first latching body 21 and the first latching recess 20 of the catch element 13 (see FIG. 7).

In the embodiment shown, the latching unit 16 comprises a first linear guide 24 for displaceably mounting the release element 22 between the resting position and release position. The first linear guide 24 is further designed to guide the catch element 13 within the latching unit 16. To this end, the first linear guide 24 is extended in the insertion direction of the catch element 13 (see arrow 25 on FIG. 3). The latching unit 16 also comprises a second linear guide 26 in the form of an oblong hole guide for displaceably mounting the first latching body 21 between a first position engaged with the first latching recess 20 of the catch element 13 (see FIG. 6) and a second position that releases the catch element 13 (see FIG. 5, 7). In the embodiment shown, the second linear guide 26 extends essentially perpendicular to the first linear guide 24. The latching unit 16 also comprises a first spring element 27, so that the first latching body 21 can be displaced against the spring force of the first spring element 27 from the first position engaged with the first latching recess 20 of the catch element 13 (see FIG. 6) into the second position that releases the catch element 13 (see FIGS. 5 and 7).

In the embodiment shown, the catch element 13 is designed as an oblong flat part, wherein the first latching recess 20 is provided in the form of a notch on a first longitudinal edge 28 of the oblong flat part. In addition, the release element 22 in the embodiment shown is designed as an elongated flat piece. The first receiving opening 23 is provided in the form of a notch on a first longitudinal edge 29 of the elongated flat piece.

In the embodiment shown, the latching unit 16 comprises a second latching body 30 for engagement with a second latching recess 31 of the catch element 13 and for receiving in a second receiving opening 32 of the release element 22. The second latching recess 31 of the catch element 13 is provided on a second longitudinal edge 33 of the catch element 13, and the second receiving opening 32 of the release element 22 is provided on a second longitudinal edge 35 of the release element.

A respective cylinder element is provided as the first latching body 21 and as the second latching body 30. The second latching body 30 is mounted on the latching unit 16 in the same manner as the first latching body 21. Consequently, in particular a second spring element 36 is provided, which presses the second latching body 30 in the direction of the first position. The second latching body 30 can here be displaced along a third longitudinal guide 37 in the form of an oblong hole guide, which extends essentially perpendicularly to the first linear guide 24 of the latching unit 16.

The function of the locking device 11 while closing the sliding door 1 is evident from the sequence according to FIGS. 3 to 6. The catch element 13 together with the door leaf 6 moved from the open into the closed position are first displaced in the direction of the latching unit 16 until the catch element 13 enters into the latching unit 16 through the oblong entry opening 19 (see FIG. 3). Continuing to advance the catch element 13 causes a front end area of the catch element 13 to strike the first latching body 21 and the second latching body 30 (see FIG. 4). The front end area of the catch element 13 comprises two run-up surfaces 38 that rise toward the back relative to the insertion direction 25, which press the first latching body 21 and the second latching body 30 to the outside into their second positions against a spring force (see FIG. 5), until the first latching body 21 snaps into the first latching recess 20, and the second latching body 31 snaps into the second latching recess 31 of the catch element 13. At the same time, the first latching body 21 is arranged in the first receiving opening 23, and the second latching body 30 is arranged in the second receiving opening 32 of the release element 22. As a consequence, the catch element 13 and the first 21 or second latching body 30 are in the engaged state. The release element 22 is arranged in the resting state, in which the release element 22 has no influence on the engagement between the catch element 13 and the first 21 or second latching body 30.

In order to open the door, the release element 22 is displaced via a handle coupled thereto (not shown) in such a way that activating surfaces 39 of the release element 22 (see FIG. 7) release the latching engagement between the catch element 13 and the first 21 or second latching body 30. As a result, the catch element 13 can be removed from the latching unit 16 opposite the insertion direction 25, i.e., in the removal direction 40.

Figure 8:
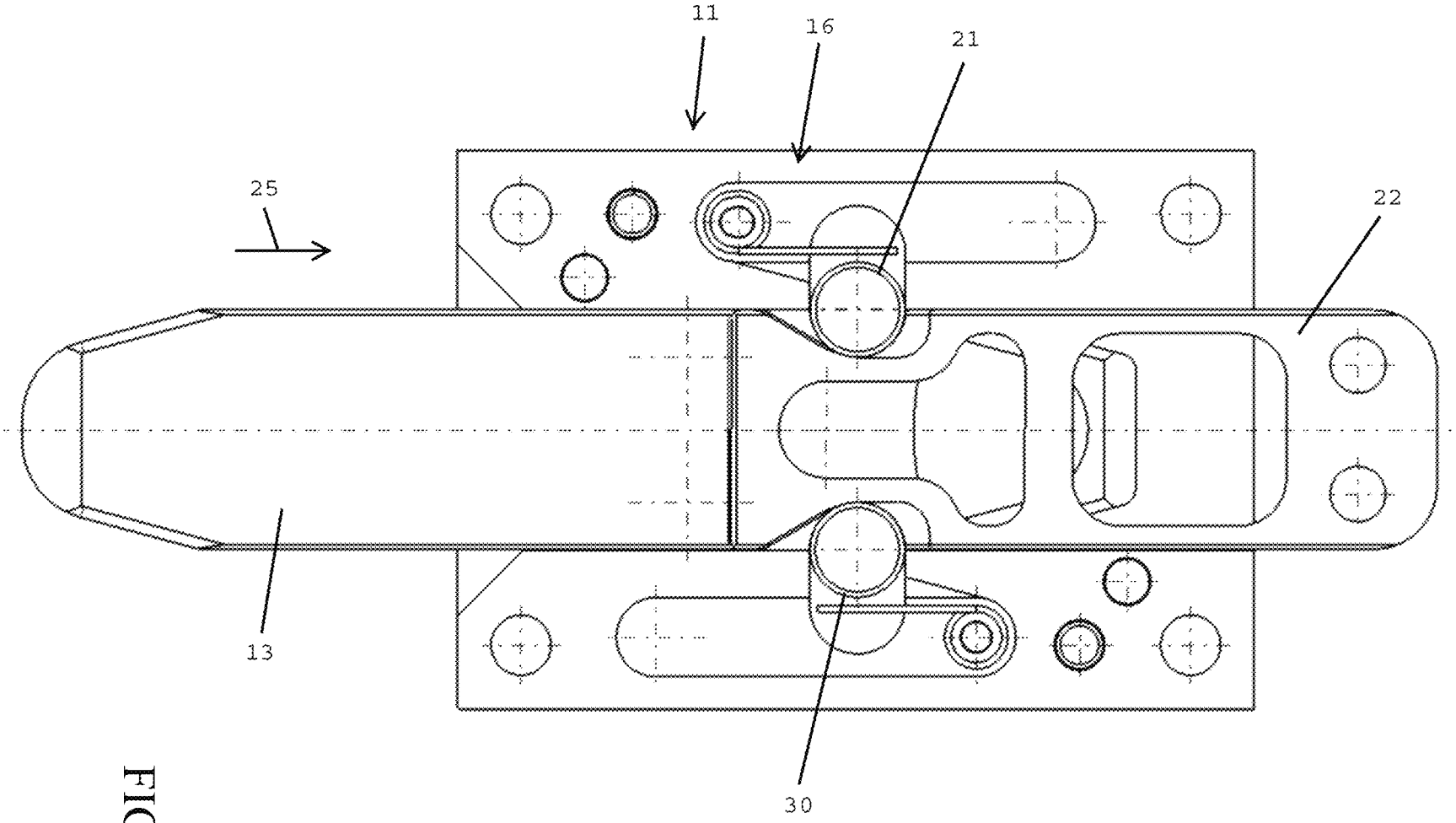
FIG. 8 shows a view of an embodiment of the locking device, which can be disengaged by applying a tensile force to the release element.

In the embodiment according to FIG. 8, disengagement can be accomplished by a tensile force on the release element 22 in the insertion direction 25 of the catch element 13.

Figure 9:
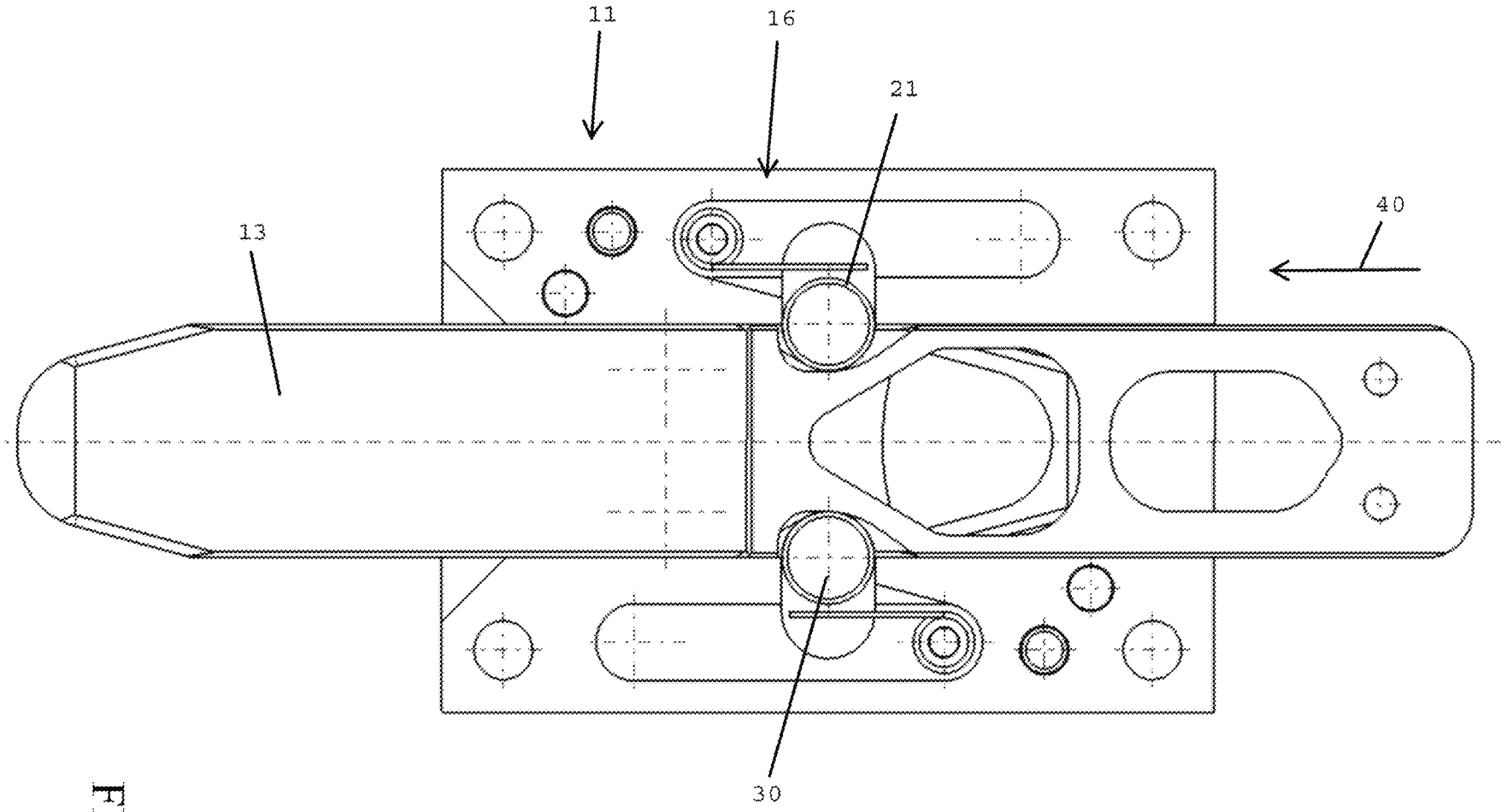
FIG. 9 shows a view of another embodiment of the locking device, which can be disengaged by applying a compressive force to the release element.

By contrast, the locking device 11 can be disengaged in the embodiment on FIG. 9 by pressing the release element 22 opposite the insertion direction 25, i.e., in the removal direction 40, of the catch element 13.

The embodiments on FIGS. 10, 11 and 12 or 13 differ in terms of the remaining movability of the catch element 13 in the engaged state on the latching unit 16.

Figure 10:
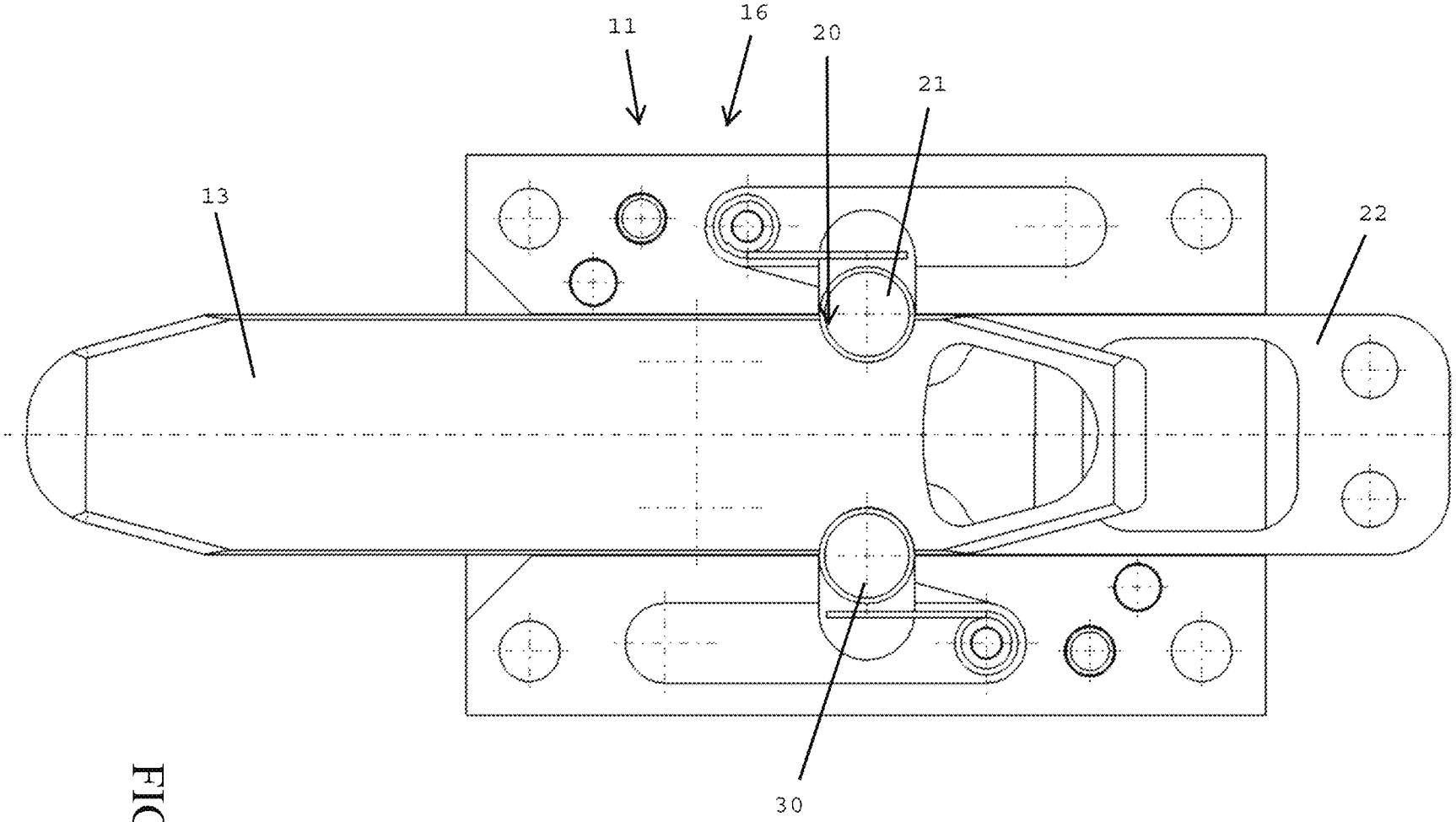
FIG. 10 shows a view of another embodiment of the locking device, in which the catch element in the engaged state is immovably arranged on the latching unit.

According to FIG. 10, the catch element 13 in the engaged state is immovably arranged on the latching unit 16. To this end, the width (here the diameter) of the first latching body 21 essentially corresponds to precisely the width of the first latching recess 20 of the catch element 13. The same holds true for the second latching body 30 and the second latching recess 31 of the catch element 13.

Figure 11:
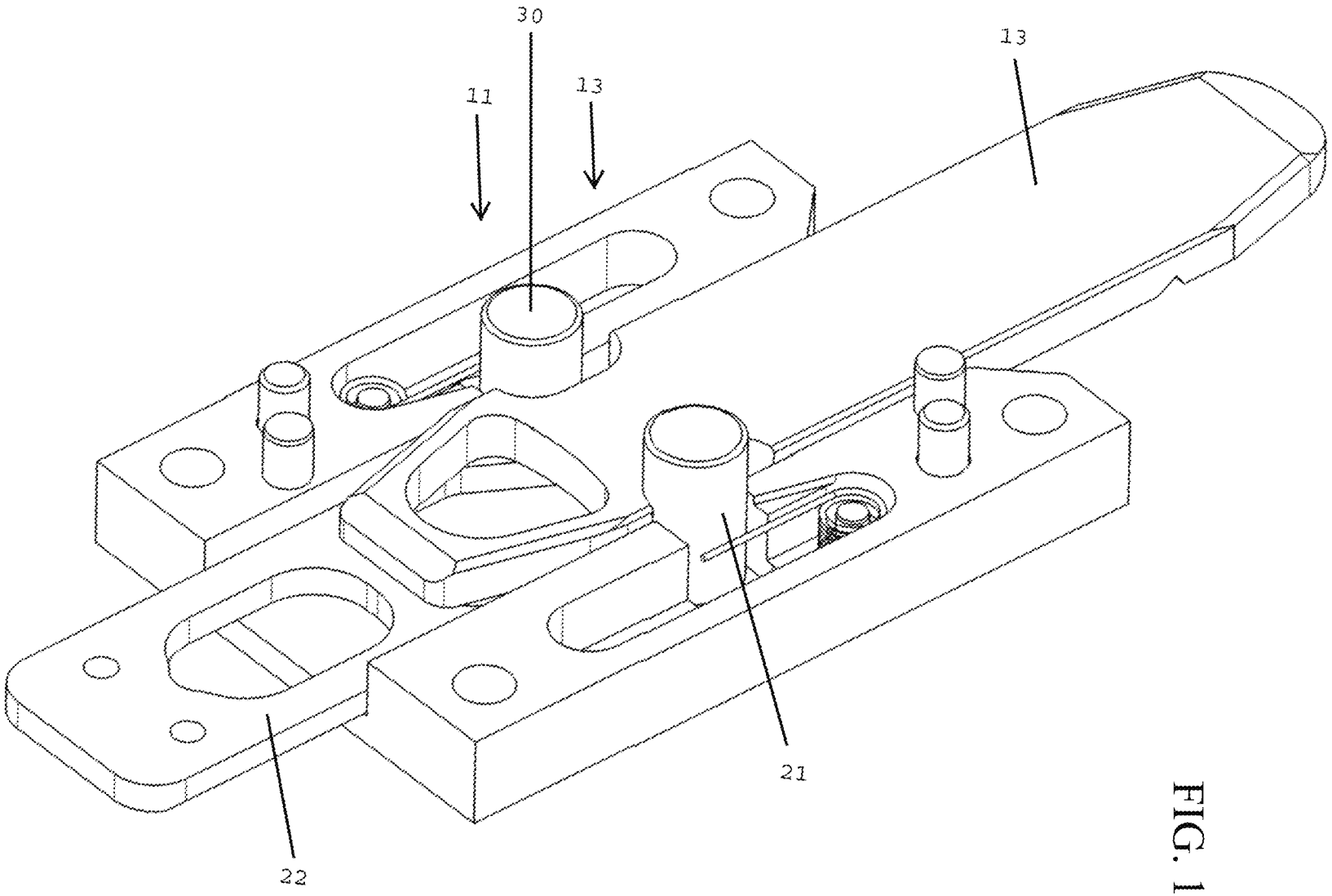
FIGS. 11 and, 12 show views of another embodiment of the locking device, in which the catch element in the engaged state is arranged on the latching unit so that it can be displaced over a defined stretch.
Figure 12:
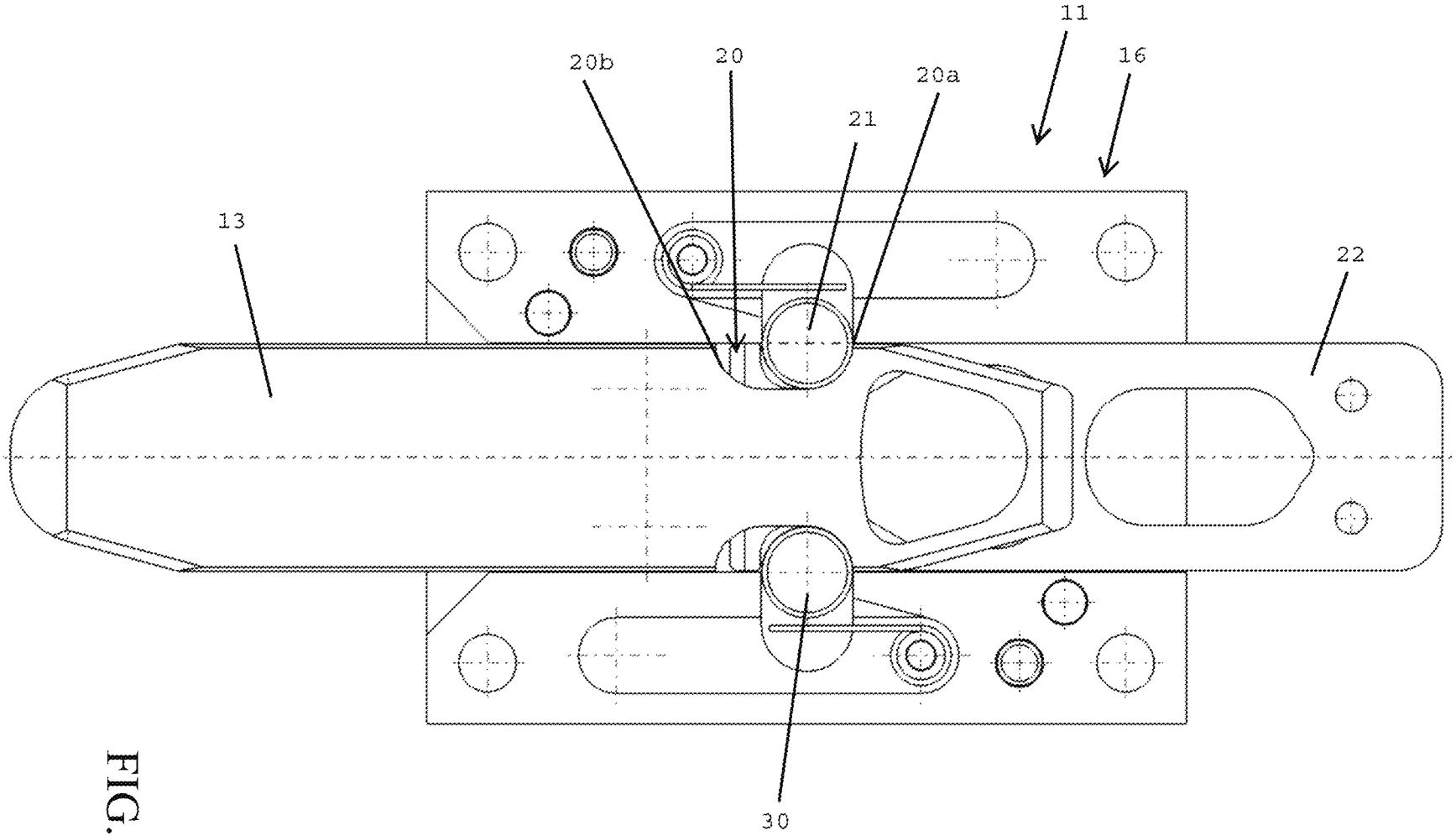

According to FIGS. 11 and 12, the catch element 13 in the engaged state is arranged on the latching unit 16 so that it can be displaced over a defined stretch. To this end, the first latching body 21 comprises a smaller width than the first latching recess 20 of the catch element. As a consequence, the first latching recess 20 of the catch element 13 comprises a first locking surface 20*a* on the front end (as viewed in the insertion direction 25) and a second locking surface 20*b* on the rear end. When the first latching body 21 is in contact with the first locking surface 20*a*, a displacement of the catch element 13 is blocked in the removal direction 40. Accordingly, a displacement of the catch element 13 in the insertion direction 25 is blocked when the first latching body 21 is in contact with the second locking surface 20*b*. The same holds true for the second latching body 30 and the second latching recess 31 of the catch element 13.

Figure 13:
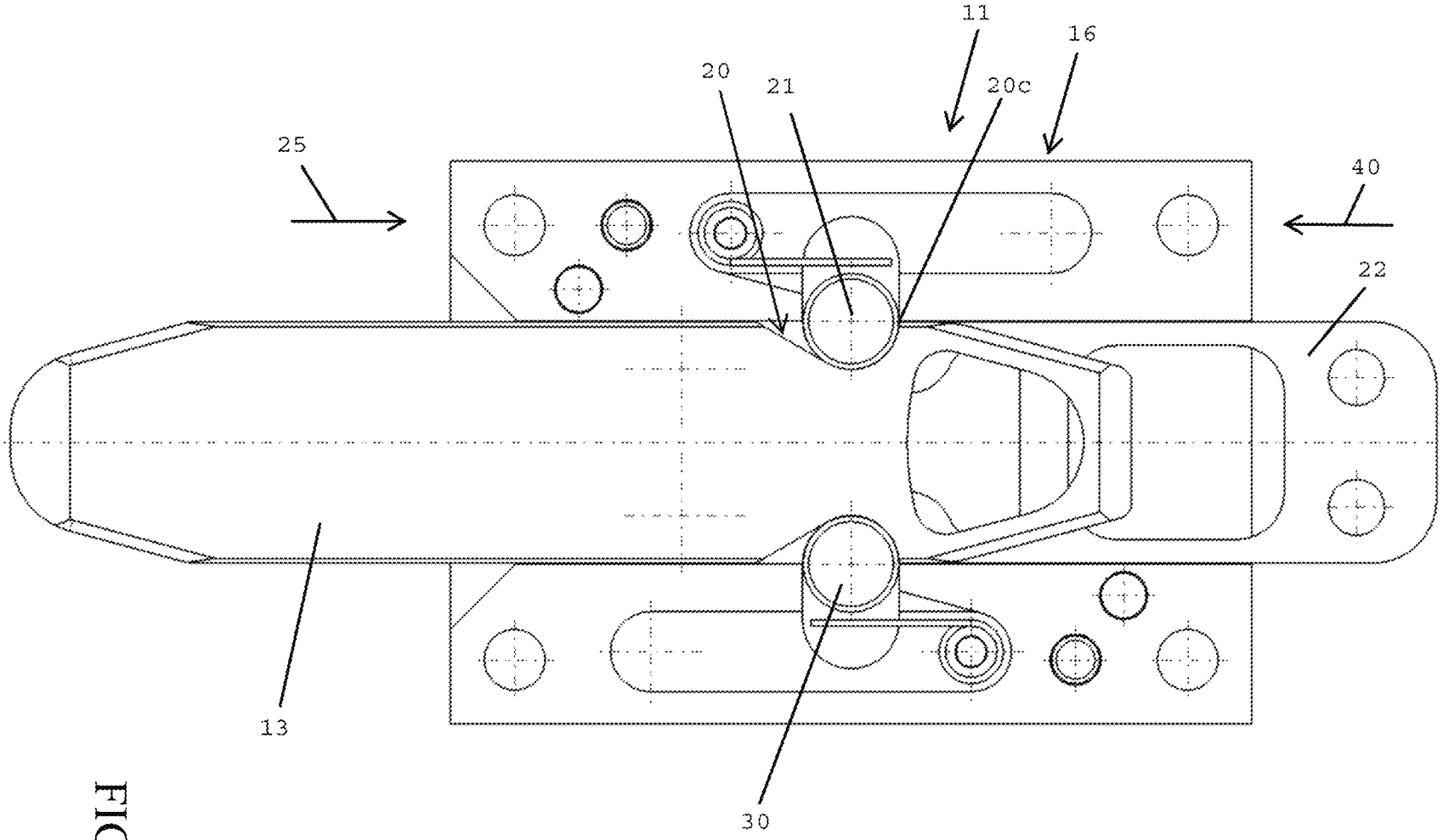
FIG. 13 shows a view of another embodiment of the locking device, in which the catch element in the engaged state is arranged on the latching unit immovably opposite the insertion direction of the catch element, but displaceably in the insertion direction of the catch element.

According to FIG. 13, the catch element 13 in the engaged state is arranged on the latching unit 16 so that it cannot be displaced in the removal direction 40 of the catch element 13, but can be displaced in the insertion direction 25 of the catch element 13. To this end, the latching recess 20 comprises a retaining surface 20*c* that blocks the movement of the catch device 13 in the removal direction 40 at the front end (as viewed in the insertion direction 25). The rear end of the latching recess 20 is provided with a run-up surface 20*d*, which is flatter than the retaining surface 20*c*. This releases a further displacement of the catch element 13 in the engaged state in the insertion direction 25 of the catch element 13. In this embodiment, a stop element is formed outside of the latching unit 16, so as to fix the end position of the catch element 13 during a displacement in the insertion direction 25.

The invention claimed is:

1. A locking device for locking a first component, in particular a door leaf, to a second component, in particular to a door frame comprising:

a catch element for fastening to one of the first or second component, wherein the catch element comprises at least one first latching recess, and a latching unit comprising a housing for fastening to the other one of the first or second component, wherein the latching unit comprises at least one first latching body for engagement with the at least one first latching recess of the catch element, wherein the latching unit comprises a release element, which comprises at least one first receiving opening for receiving the at least one first latching body, wherein the release element is moveable between a resting position, which arranges the at least one first latching body in the at least one first latching recess of the catch element and in the at least one receiving opening of the release element, and a release position, which releases the engagement between the at least one first latching body and the at least one first latching recess of the catch element, wherein the catch element is designed as an oblong flat part, and at least one of the at least one first latching recess is provided on a first longitudinal edge of the oblong flat part, wherein the latching unit comprises a first linear guide provided on the housing, the first linear guide for displaceably mounting the release element between the resting position and release position, and wherein the latching unit comprises a second linear guide provided on the housing, the second linear guide for displaceably mounting the at least one first latching body between a first position engaged with the at least one first latching recess of the catch element and a second position that releases the catch element, wherein the second linear guide extends essentially perpendicularly to the first linear guide.

2. The locking device according to claim 1, wherein the latching unit comprises at least one first spring element, wherein the at least one first latching body is displaceable against the spring force exerted by the at least one first spring element from the first position engaged with the at least one first latching recess of the catch element into the second position that releases the catch element.

3. The locking device according to claim 1, wherein the release element is designed as an oblong flat piece, wherein the first receiving opening is provided on a first longitudinal edge of the oblong flat piece.

4. The locking device according to claim 1, wherein the latching unit comprises a second latching body for engagement with a second latching recess of the catch element and for receiving in a second receiving opening of the release element, wherein the second latching recess of the catch element is provided on a second longitudinal edge of the catch element and the second receiving opening of the release element is provided on a second longitudinal edge of the release element.

5. The locking device according to claim 1, wherein the catch element in an engaged state is essentially immovably fixed on the latching unit between the at least one first latching body and the at least one first latching recess of the catch element.

6. The locking device according to claim 1, wherein the at least one first latching recess of the catch element comprises a first locking surface and a second locking surface, such that the catch element in an engaged state between the at least one first latching body and the at least one first latching recess of the catch element is arranged on the latching unit so that it can be moved over a defined stretch.

7. The locking device according to claim 6, wherein the catch element in the engaged state between the at least one first latching body and the at least one first latching recess of the catch element is arranged displaceably on the latching unit in the one direction, and essentially immovably on the latching unit in the other direction.

8. The locking device according to claim 4, wherein a cylinder element is provided as the first and/or second latching body.

9. A sliding door, in particular for an aircraft comprising:

a door frame, a door leaf that is displaceable between an open position and a closed position relative to the door frame, and a locking device for locking the door leaf to the door frame, wherein the locking device comprises a catch element for fastening to one of the door leaf or the door frame, wherein the catch element comprises at least one first latching recess with a latching unit comprising a housing for fastening to the other one of the door leaf or door frame, wherein the latching unit comprises at least one first latching body for engagement with the at least one latching recess of the catch element, wherein the latching unit comprises a release element which comprises at least one first receiving opening for receiving the at least one first latching body, wherein the release element is moveable between a resting position, which arranges the at least one first latching body in the at least one first latching recess of the catch element and in the at least one receiving opening of the release element, and a release position, which releases the engagement between the at least one first latching body and the at least one first latching recess of the catch element, wherein the catch element is designed as an oblong flat part, and the at least one first latching recess is provided on a first longitudinal edge of the oblong flat part, wherein the latching unit comprises a first linear guide provided on the housing, the first linear guide for displaceably mounting the release element between the resting position and release position, and wherein the latching unit comprises a second linear guide provided on the housing, the second linear guide for displaceably mounting the at least one first latching body between a first position engaged with the at least one first latching recess of the catch element and a second position that releases the catch element, wherein the second linear guide extends essentially perpendicularly to the first linear guide.

10. The sliding door according to claim 9, wherein the locking device is designed for locking the door leaf in the closed position, wherein an additional locking device is provided for locking the door leaf in the open position.

11. The sliding door according to claim 9, wherein the door leaf comprises an upper door part and a lower door part, which are arranged in an extended position in the closed position of the door leaf, and in a pushed together stowage position in the open position.

12. The sliding door according to claim 11, wherein the door frame comprises a guide rail that runs at an angle of inclination to the horizontal for displaceably mounting the door leaf, so that the displacement of the door leaf between the closed and open position can be converted into a displacement of the upper door part and lower door part opposite each other between the extended position and the pushed together stowage position.

* * * * *